US011920793B1

(12) United States Patent
Strzepek et al.

(10) Patent No.: US 11,920,793 B1
(45) Date of Patent: Mar. 5, 2024

(54) ADJUSTABLE GASEOUS FUEL INJECTOR

(71) Applicant: Pratt & Whitney Canada Corp., Longueuil (CA)

(72) Inventors: Jakub Strzepek, Rzeszow (PL); Kian McCaldon, Orangeville (CA); Anna Mamrol, Tyczyn (PL); Owen Wong, Markham (CA); Maxime La Fleche, Gatineau (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/213,543

(22) Filed: Jun. 23, 2023

(51) Int. Cl.
*F23R 3/12* (2006.01)
*F23R 3/22* (2006.01)
*F23R 3/28* (2006.01)

(52) U.S. Cl.
CPC ..... *F23R 3/283* (2013.01); *F23R 3/12* (2013.01); *F23R 3/22* (2013.01); *F23R 3/286* (2013.01); *F23D 2900/14481* (2013.01)

(58) Field of Classification Search
CPC ..... F23R 3/12; F23R 3/18–22; F23C 5/06; F23D 11/26; F23D 11/406; F23D 2900/14481
See application file for complete search history.

(56) References Cited

U.S. PATENT DOCUMENTS 3,788,067 A * 1/1974 Carlisle ..... F23D 17/002 60/742
4,092,826 A * 6/1978 Pask ..... F23D 11/107 239/404
4,199,934 A * 4/1980 Meyer ..... F23R 3/02 60/39.23
4,246,757 A * 1/1981 Heberling ..... F23R 3/14 60/737
4,338,076 A * 7/1982 Straumann ..... F23D 11/406 431/278
4,350,009 A * 9/1982 Holzapfel ..... F23R 3/10 60/39.23
4,373,325 A * 2/1983 Shekleton ..... F23R 3/14 60/737
4,713,938 A * 12/1987 Willis ..... F23R 3/28 60/742
4,976,607 A * 12/1990 Grimard ..... F23C 7/008 239/428
5,319,923 A 6/1994 Leonard
(Continued)

*Primary Examiner* — Todd E Manahan
*Assistant Examiner* — Marc J Amar
(74) *Attorney, Agent, or Firm* — Getz Balich LLC

(57) ABSTRACT

A fuel injector for a gas turbine engine combustor is provided that includes a swirler, a mounting stage, and a distributor. The swirler has a shaft, a collar, a throat section, and first and second axial ends. The throat section includes an inner radial surface that defines a central passage that extends between the swirler inner bore and the collar. The collar includes a plurality of apertures extending therethrough disposed radially outside of the central passage. The mounting stage is disposed in the inner bore, and has an annular flange, a central hub, and at least one strut. The distributor has a stem attached to a head. The stem has a distal end opposite the head portion engaged with the central hub. The head portion has an end surface and a side surface. The distributor is selectively positionable relative to the throat section.

20 Claims, 5 Drawing Sheets

(56) References Cited

U.S. PATENT DOCUMENTS

| | | | | |
|---|---|---|---|---|
| 5,749,219 | A * | 5/1998 | DuBell | F23R 3/346 60/737 |
| 6,925,809 | B2 * | 8/2005 | Mowill | F23R 3/30 60/39.23 |
| 2004/0181957 | A1 * | 9/2004 | Polkhouskiy | F23Q 3/006 33/652 |
| 2005/0106520 | A1 * | 5/2005 | Cornwell | F23R 3/18 431/9 |
| 2012/0006029 | A1 * | 1/2012 | Bilbao | F23R 3/14 60/737 |
| 2016/0069298 | A1 * | 3/2016 | Peters | F02C 7/222 60/765 |
| 2019/0203929 | A1 * | 7/2019 | Benjamin | F23R 3/286 |
| 2023/0080006 | A1 * | 3/2023 | Swann | F02C 9/16 60/39.27 |

* cited by examiner

ADJUSTABLE GASEOUS FUEL INJECTOR

BACKGROUND OF THE INVENTION

1. Technical Field

This disclosure relates to combustor injectors for gas turbine engines in general, and to systems and methods for calibrating combustor injectors in particular.

2. Background Information

In order to maximize part durability, and to control emissions, ignition and flame stability, it is necessary to calibrate gas turbine fuel injectors to obtain a tight control over the fuel flow rate for individual fuel injectors. In the case of fuel injectors for small gas turbine engines, common manufacturing tolerances generally result in an excessive variation in flow rate. The fuel injectors then require adjustment or calibration prior to use. What is needed is a combustor fuel injector that can be used for injection fuels including but not limited to gaseous hydrogen fuel, one that is capable of being readily calibrated.

SUMMARY

A fuel injector for a gas turbine engine combustor is provided. The fuel injector has an axial centerline and includes a swirler, a mounting stage, and a distributor. The swirler has a shaft, a collar, a throat section, and first and second axial ends. The shaft extends from the first axial end to the collar and includes an inner bore therethrough. The throat section includes an inner radial surface that defines a central passage that extends between the swirler inner bore and the collar. The collar includes a plurality of apertures extending therethrough disposed radially outside of the central passage. The mounting stage is disposed in the inner bore, and has an annular flange, a central hub, and at least one strut extending radially between the annular flange and the central hub. The distributor has a stem attached to a head. The stem has a distal end opposite the head portion engaged with the central hub. The head portion has an end surface and a side surface that extends between the end surface and the stem. The head has a diameter that decreases in a direction from the end surface to the stem. The distributor is selectively positionable relative to the throat section.

In any of the aspects or embodiments described above and herein, the inner radial surface may be separated from the side surface by a separation distance, and the distributor may be selectively positionable relative to the throat section in a first position having a first separation distance and in a second position having a second separation distance, and the second separation distance is greater than the first separation distance.

In any of the aspects or embodiments described above and herein, the distributor head may be conical-shaped and at least a portion of the side surface may extend along a straight line.

In any of the aspects or embodiments described above and herein, the distributor stem may be threadedly engaged with the mounting stage central hub.

In any of the aspects or embodiments described above and herein, the central hub may include a threaded aperture configured for threaded engagement with the distributor stem, and in the first position, the distal end of the distributor stem may be disposed a first engagement distance within the threaded aperture and in the second position the distal end of the distributor stem may be disposed a second engagement distance within the threaded aperture, and the first engagement distance is greater than the second engagement distance.

In any of the aspects or embodiments described above and herein, the mounting stage may include a stem locking mechanism configured to lock the distributor stem relative to the central hub. The stem locking mechanism may include a set screw.

In any of the aspects or embodiments described above and herein, the at least one strut of the mounting stage may be a plurality of vanes, each vane extending radially between the annular flange and the central hub.

In any of the aspects or embodiments described above and herein, the inner bore may include a first inner bore disposed at a first inner bore diameter and a second inner bore disposed at a second inner bore diameter, wherein the second inner bore diameter is less than the first inner bore diameter, and the mounting stage may be disposed within the second inner bore and the first inner bore may be configured to receive a fuel tube.

In any of the aspects or embodiments described above and herein, the mounting stage may be threadedly engaged with the inner bore.

In any of the aspects or embodiments described above and herein, at least one shim may be disposed axially between a base surface of the inner bore and the annular flange of the mounting stage.

In any of the aspects or embodiments described above and herein, the inner bore may include a first inner bore disposed at a first inner bore diameter and a second inner bore disposed at a second inner bore diameter, wherein the second inner bore diameter is less than the first inner bore diameter, and the mounting stage may be threadedly engaged with the second inner bore, and the fuel injector may further comprise at least one shim disposed axially between a base surface of the second inner bore and the annular flange of the mounting stage.

In any of the aspects or embodiments described above and herein, the mounting stage may be received within the inner bore by a slide fit and a member threadedly engaged with the inner bore may capture the mounting stage within the inner bore.

In any of the aspects or embodiments described above and herein, at least one shim may be disposed axially between a base surface of the inner bore and the annular flange of the mounting stage.

In any of the aspects or embodiments described above and herein, a mounting stage locking mechanism configured to lock the mounting stage relative to the swirler may be included.

In any of the aspects or embodiments described above and herein, the central passage may have a first diameter at a first axial position between the swirler inner bore and the collar and a second diameter at a second axial position between the swirler inner bore and the collar, wherein the first axial position and the second axial position are axially spaced apart from one another, and the second diameter is less than the first diameter.

In any of the aspects or embodiments described above and herein, the central passage may converge in a direction from the first axial position to the second axial position and the second axial position is disposed closer to the collar than the first axial position.

In any of the aspects or embodiments described above and herein, the fuel injector may be configured for use with a gaseous fuel.

According to an aspect of the present disclosure, a method of calibrating a gas turbine engine combustor having a plurality of fuel injectors is provided. The method including providing a plurality of fuel injectors that includes at least one adjustable fuel injector, the adjustable fuel injector including a swirler, a mounting stage, and a distributor. The swirler has a shaft, a collar, a throat section, and first and second axial ends. The shaft extends from the first axial end to the collar and includes an inner bore therethrough. The throat section includes an inner radial surface that defines a central passage that extends between the swirler inner bore and the collar. The collar includes a plurality of apertures extending therethrough disposed radially outside of the central passage. The mounting stage is disposed in the inner bore, and has an annular flange, a central hub, and at least one strut extending radially between the annular flange and the central hub. The distributor has a stem attached to a head. The stem has a distal end opposite the head portion engaged with the central hub. The head portion has an end surface and a side surface that extends between the end surface and the stem. The head has a diameter that decreases in a direction from the end surface to the stem. The distributor is selectively positionable relative to the throat section. the method further includes adjusting the at least one adjustable fuel injector (AFI) by positioning the distributor relative to the throat section of the adjustable fuel injector to produce an AFI fuel flow distribution that substantially matches a fuel flow distribution of each of the other of the fuel injectors of the plurality of fuel injectors. The fuel injectors may be configured for use with a gaseous fuel.

The foregoing features and elements may be combined in various combinations without exclusivity, unless expressly indicated otherwise. For example, aspects and/or embodiments of the present disclosure may include any one or more of the individual features or elements disclosed above and/or below alone or in any combination thereof. These features and elements as well as the operation thereof will become more apparent in light of the following description and the accompanying drawings. It should be understood, however, the following description and drawings are intended to be exemplary in nature and non-limiting.

DETAILED DESCRIPTION

Figure 1:
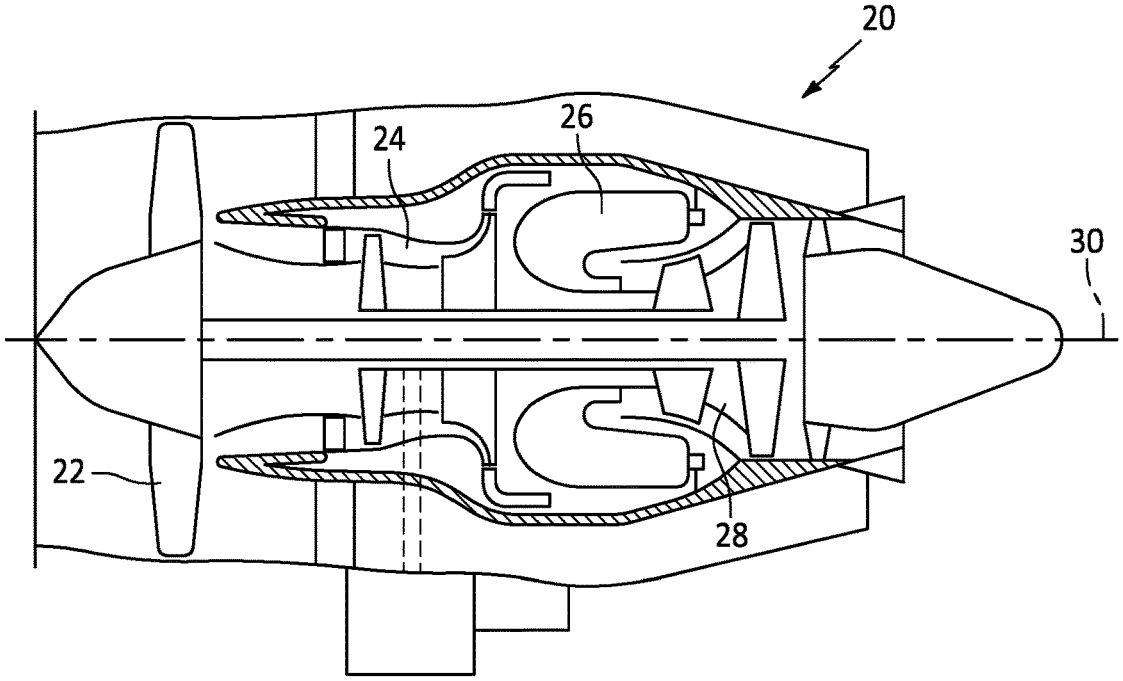
FIG. 1 is a diagrammatic representation view of a turbine engine.

FIG. 1 illustrates a gas turbine engine 20 of a type preferably provided for use in subsonic flight. The gas turbine engine 20 has in serial flow communication a fan 22, a compressor section 24, a combustor 26, a turbine section 28, and an axial centerline 30. The combustor 26 includes one or more fuel injectors 32.

Figure 2:
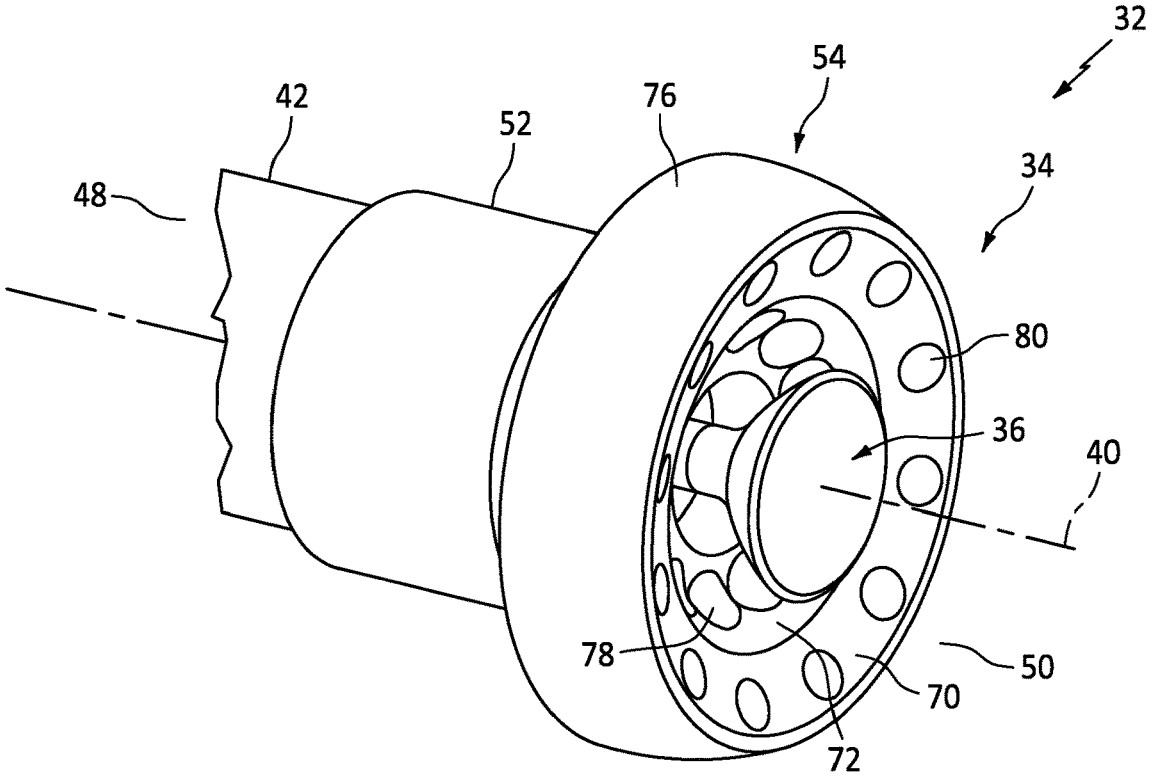
FIG. 2 is a diagrammatic perspective view of a present disclosure fuel injector embodiment.
Figure 3:
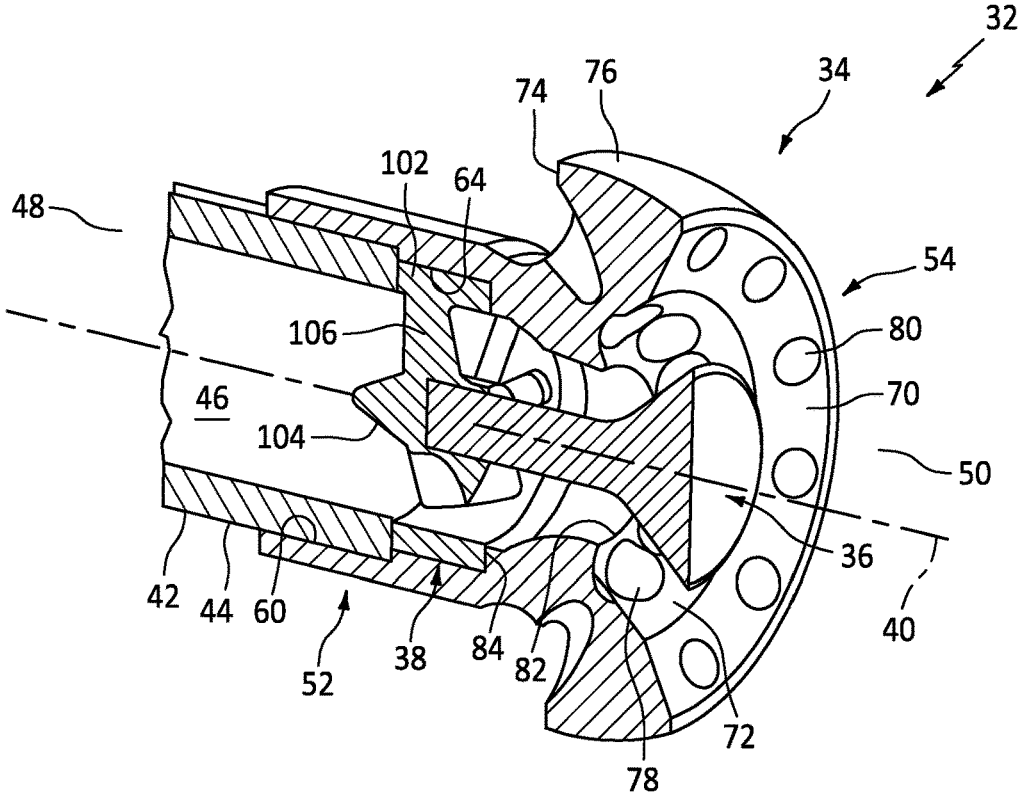
FIG. 3 is a diagrammatic sectional view of the present disclosure fuel injector embodiment shown in FIG. 2.

Referring to FIGS. 2 and 3, the fuel injector 32 includes a swirler 34, a distributor 36, and a mounting stage 38 (see FIG. 3) all disposed about a central axis 40. The fuel injector 32 is configured to directly or indirectly communicate with a fuel tube 42 that is a conduit for providing a fluid (gas or liquid) from a fuel source to the fuel injector 32. A fuel tube 42 that is in direct communication with the fuel injector 32 may be in communication with the swirler 34 component of the fuel injector 32. A fuel tube 42 that is in indirect communication with the fuel injector 32 may be in communication with a coupling or other intermediary component that is in communication with the fuel injector swirler 34. To facilitate the description herein, unless otherwise noted the present disclosure will be described in terms of a fuel tube 42 in direct communication with the fuel injector 32 but is not limited thereto. The fuel tube 42 includes an outer radial surface 44 and an internal passage 46.

Figure 4:
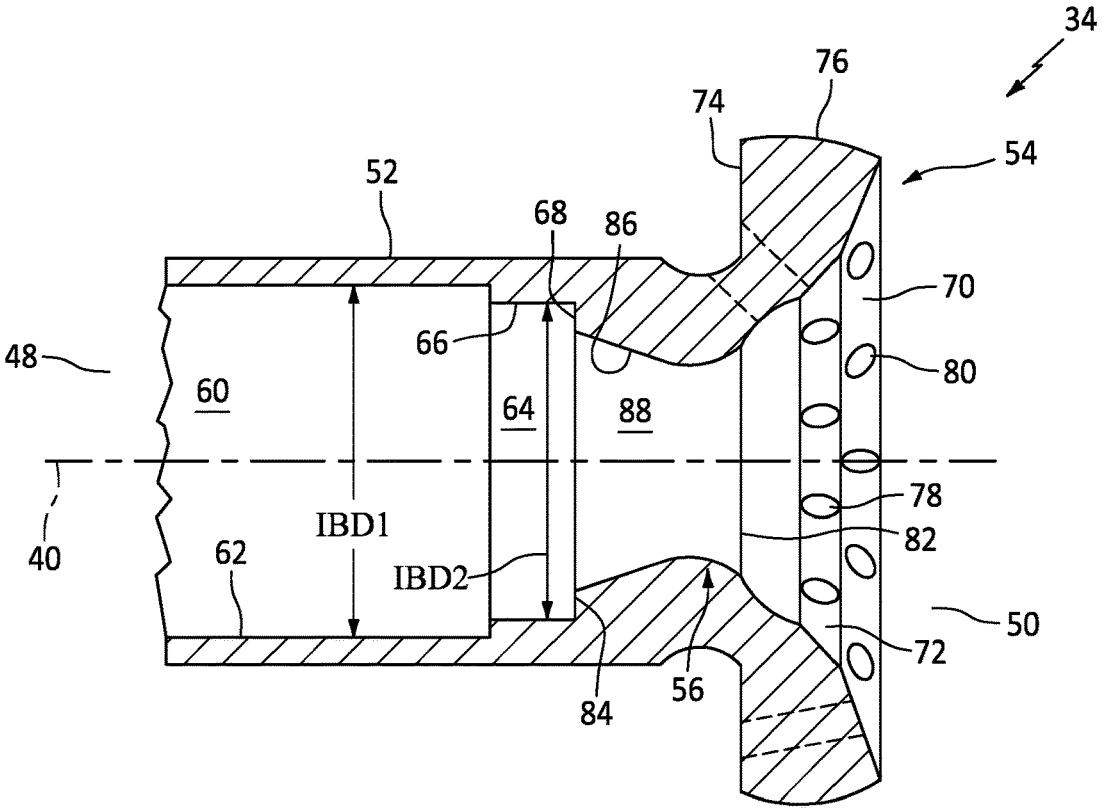
FIG. 4 is a diagrammatic sectional view of a swirler component of a present disclosure fuel injector embodiment.

Referring to FIGS. 3 and 4, the swirler 34 includes an upstream end 48, a downstream end 50, a swirler shaft 52, a collar 54, and a throat section 56 (see FIG. 4). The terms "upstream" and "downstream" used herein refer to the direction of fluid through the fuel injector 32; i.e., a fluid passing through the fuel injector 32 during its use travels from an upstream point to a downstream point. The swirler shaft 52 and the collar 54 extend along the central axis 40 between the upstream end and the downstream end. The swirler shaft 52 extends from the upstream end 48 to the collar 54 and the collar 54 extends from the downstream end 50 to the swirler shaft 52. In the embodiment shown in FIGS. 3 and 4, the swirler shaft 52 includes a first inner bore 60 defined by a first inner radial surface 62 disposed at a diameter IBD1 and a second inner bore 64 defined by a second inner radial surface 66 disposed at a diameter IBD2 (where IBD1>IBD2) and a base surface 68. The first inner bore 60 is disposed axially between the upstream end 48 and the second inner bore 64. The present disclosure is not limited to a swirler shaft 52 embodiment having first and second inner bores 60, 64. For example, in the embodiment diagrammatically shown in FIG. 8, the swirler shaft 52 includes an inner bore 160 defined by an inner radial surface 60A and a base surface 68A.

The collar 54 is defined by a first front end surface 70, a second front end surface 72, a rear surface 74, an outer radial surface 76, a plurality of inner radial apertures 78, and a plurality of outer radial apertures 80. The outer radial surface 76 extends axially between the first front end surface 70 and the rear surface 74. The second front end surface 72 extends between the throat section 56 and the first front end surface 70. The inner radial apertures 78 extend between the rear surface 74 and the second front end surface 72, and the outer radial apertures 80 extend between the rear surface 74 and the first front end surface 70. The inner radial apertures 78 are circumferentially spaced apart from one another around the second front end surface 72; e.g., uniformly circumferentially spaced. The outer radial apertures 80 are circumferentially spaced apart from one another around the first front end surface 70; e.g., uniformly circumferentially spaced. The outer radial apertures 80 are disposed radially outside of the inner radial apertures 78. The present disclosure is not limited to any particular configuration of the inner and/or outer radial apertures 78, 80 (e.g., geometric shape, volumetric size, angular orientation, and the like) and is not limited to any particular number of inner and/or outer radial apertures 78, 80.

Figure 4A:
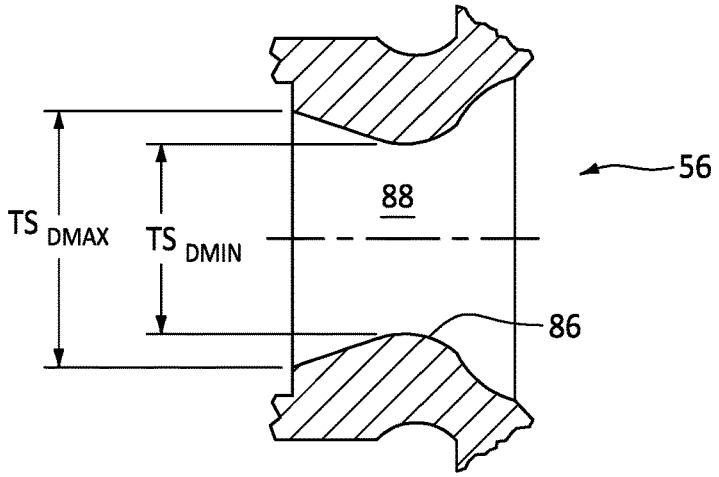
FIG. 4A is an enlarged partial view of a swirler component shown in FIG. 4.

The throat section 56 extends between a downstream end 82 that is contiguous with the second front end surface 72 and an upstream end 84 that is contiguous with the second inner bore 64. The throat section 56 includes an inner radial surface 86 that defines a central passage 88 that extends between the downstream and upstream ends 82, 84. The central passage 88 has an inner diameter that may vary between the downstream and upstream ends 82, 84. In the embodiments shown in FIGS. 3 and 4, the inner radial surface 86 is arcuately shaped and has a maximum diameter "$TS_{DMAX}$" and a minimum diameter "$TS_{DMIN}$" (see FIG. 4A). The present disclosure is not limited to an arcuately shaped inner radial surface 86.

Figure 5:
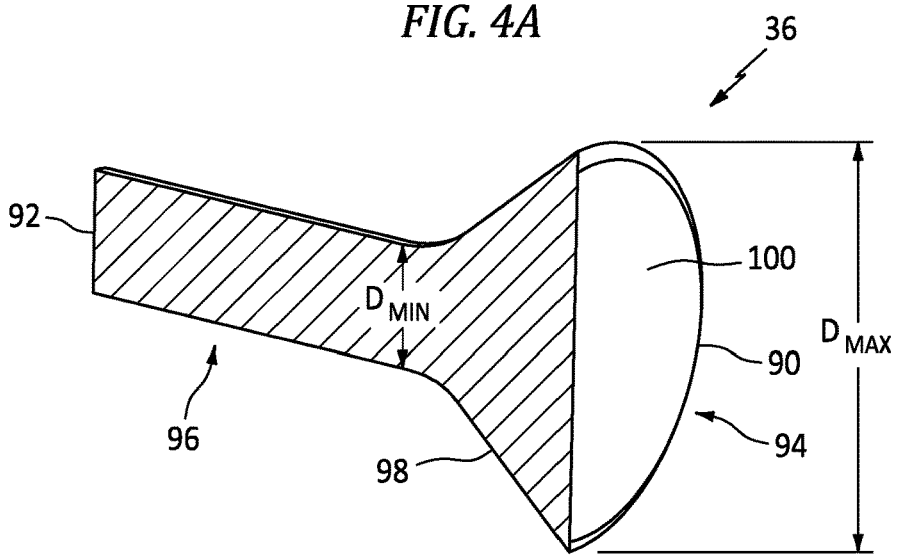
FIG. 5 is a diagrammatic sectional view of a distributor component of a present disclosure fuel injector embodiment.

Referring to FIGS. 3 and 5, the distributor 36 includes a downstream end 90, an upstream end 92, a head 94, and a stem 96. The stem 96 extends from the upstream end 92 to the head 94 and the head 94 extends from the downstream end 90 to the stem 96. The head 94 includes a side wall surface 98 and an end surface 100. The configuration of the head 94 may vary depending on the application (e.g., the fuel distribution and mixing needs of the application). In the embodiment shown in FIGS. 3 and 5, the head 94 is shown as having a generally conical configuration which is a non-limiting example of a head 94 geometry. In this embodiment, the head 94 increases in diameter from the point where the side wall surface 98 intersects with the stem 96 ("$D_{MIN}$") to the point where the side wall surface 98 intersects with the end surface 100 ("$D_{MAX}$")—see FIG. 5. Another non-limiting example of a head geometry is one in which the head 94 is rectangular. The present disclosure is not limited to any particular head 94 geometry. In the embodiments shown in FIGS. 3 and 5, the side wall surface 98 has a straight line configuration. The present disclosure is not limited to a distributor 36 having a head 94 with a straight line side wall surface 98. For example, portions or all of the side wall surface 98 may have an arcuate configuration.

Figure 6:
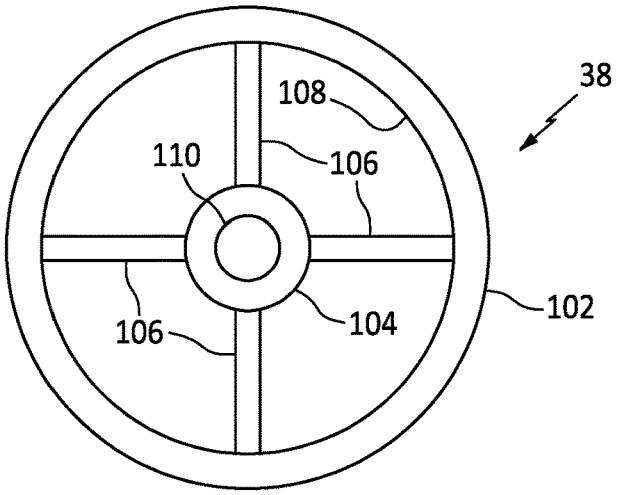
FIG. 6 is a diagrammatic planar representation of a mounting stage component of a present disclosure fuel injector embodiment.

Referring to FIGS. 3 and 6, the mounting stage 38 includes an annular flange 102, a central hub 104, and at least one radially extending strut 106. The annular flange 102 is disposed radially outside of the central hub 104 and includes an inner radial surface 108 that defines a flow boundary through the mounting stage 38. The strut 106 extends radially between annular flange 102 and the central hub 104. The central hub 104 is configured for attachment with the distributor stem 96. In the embodiment shown in FIG. 3, the mounting stage 38 is configured as a vane stage, wherein the at least one strut 106 is a plurality of vanes, each vane extending radially between the annular flange 102 and the central hub 104. Each vane may be oriented such that the chord of the vane is aligned with the central axis 40 of the fuel injector 32. Alternatively, each vane may be disposed such that its chord is skewed relative to the fuel injector central axis 40; e.g., as shown in FIG. 3. The central hub 104 is configured to support the distributor 36 and may be engaged with the distributor stem 96 in a variety of different ways. For example, a portion of the exterior surface of the stem 96 may be threaded and the central hub 104 may include a threaded aperture 110 configured to engage with the stem threads, or the distributor stem 96 and central hub 104 may be attached to one another by a mechanical fastener (e.g., a set screw, a pin, or the like), or any combination thereof. In some embodiments, the distributor stem 96 and the central hub 104 may be an integral structure. The aforesaid distributor stem 96 and central hub 104 engagement examples are provided to illustrate potential ways of attaching the distributor stem 96 and central hub 104 and the present disclosure is not limited thereto. In those embodiments that include a mechanical fastener, the mechanical fastener may be referred to as a stem locking mechanism 112 operable to lock the stem 96 within the central hub 104 of the mounting stage 38.

The mounting stage 38 may be secured within an inner bore of the swirler shaft 52 in a variety of different ways. For example, the annular flange 102 may be in threaded engagement with an inner bore, or the mounting stage 38 may be fixed within an inner bore by a mounting stage locking mechanism 114 (see FIG. 10); e.g., a set screw, or a pin, or the like that extends through the swirler shaft 52 and engages the annular flange 102 of the mounting stage 38. Alternatively, the mounting stage 38 may be fixed within an inner bore by a mounting stage locking mechanism in the form of a weldment or brazing material, or the like. The present disclosure is not limited to securing the mounting stage 38 within an inner bore of the swirler shaft 52 in any particular manner.

Referring to FIGS. 3 and 7-10, the distributor 36 is centrally received within the throat section 56 of the fuel injector 32 and extends to the mounting hub. The fuel injector 32 is configured so that the inner radial surface 86 of the throat section 56 and the distributor side wall surface 98 collectively form an annular flow passage. The separation distance between the throat inner radial surface 86 and the side wall surface 98 defines the flow area therebetween that extends circumferentially. The present disclosure is configured so that the separation distance between the throat inner radial surface 86 and the side wall surface 98 (and therefore the flow area therebetween) is selectively adjustable.

FIGS. 7-10 diagrammatically illustrate examples of a present disclosure fuel injector 32 embodiment wherein the separation distance between the throat inner radial surface 86 and the side wall surface 98 (and therefore the flow area therebetween) is selectively adjustable.

Figure 7:
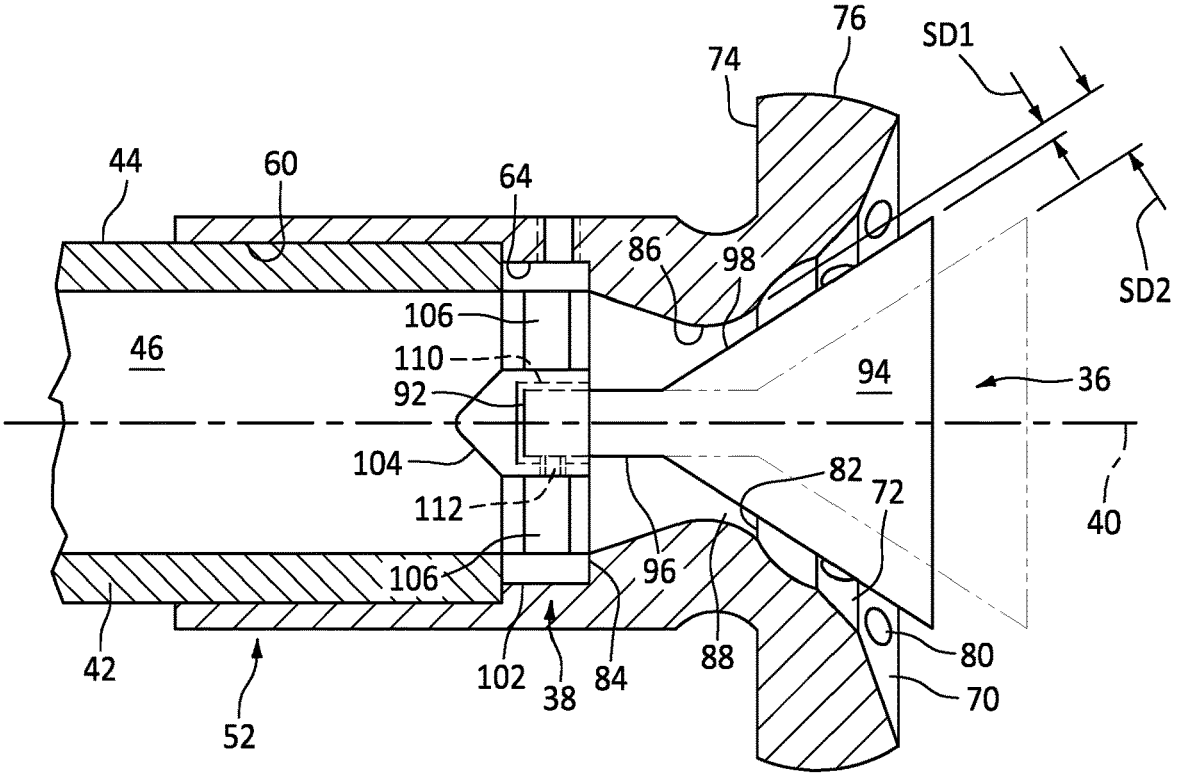
FIG. 7 is a diagrammatic planar sectioned view of a present disclosure fuel injector embodiment.

In the embodiment diagrammatically illustrated in FIG. 7, the mounting stage 38 is disposed in the second inner bore 64 of the swirler shaft 52. The mounting stage 38 is secured within the second inner bore 64 in a manner described above. Also in this embodiment, the fuel tube 42 (or a coupler in communication with the fuel tube 42) extends into the first inner bore 60 of the swirler shaft 52 and is coupled with the swirler 34. In this embodiment, a portion of the upstream end 92 of the distributor stem 96 (e.g., see FIGS. 5 and 7) is in threaded engagement with the mounting stage central hub 104. The position of the distributor side wall surface 98 relative to the throat inner radial surface 86 and may be selectively adjusted by the amount of threaded engagement between the distributor stem 96 and the mounting stage central hub 104. To decrease the separation distance between the distributor side wall surface 98 and the throat inner radial surface 86, the distributor 36 may be threaded (in a first rotational direction) further into the mounting stage central hub 104. Conversely, to increase the separation distance between the distributor side wall surface 98 and the throat inner radial surface 86, the distributor 36 may be unthreaded (in a second rotational direction, opposite the first rotational direction) an amount from the mounting stage central hub 104. FIG. 7 diagrammatically illustrates the distributor 36 disposed in a first position wherein the separation distance between the distributor side wall surface 98 and the throat inner radial surface 86 is shown as SD1 and a second position (shown in phantom line) wherein the separation distance between the distributor side wall surface 98 and the throat inner radial surface 86 is shown as SD2; wherein SD2>SD1.

Figure 8:
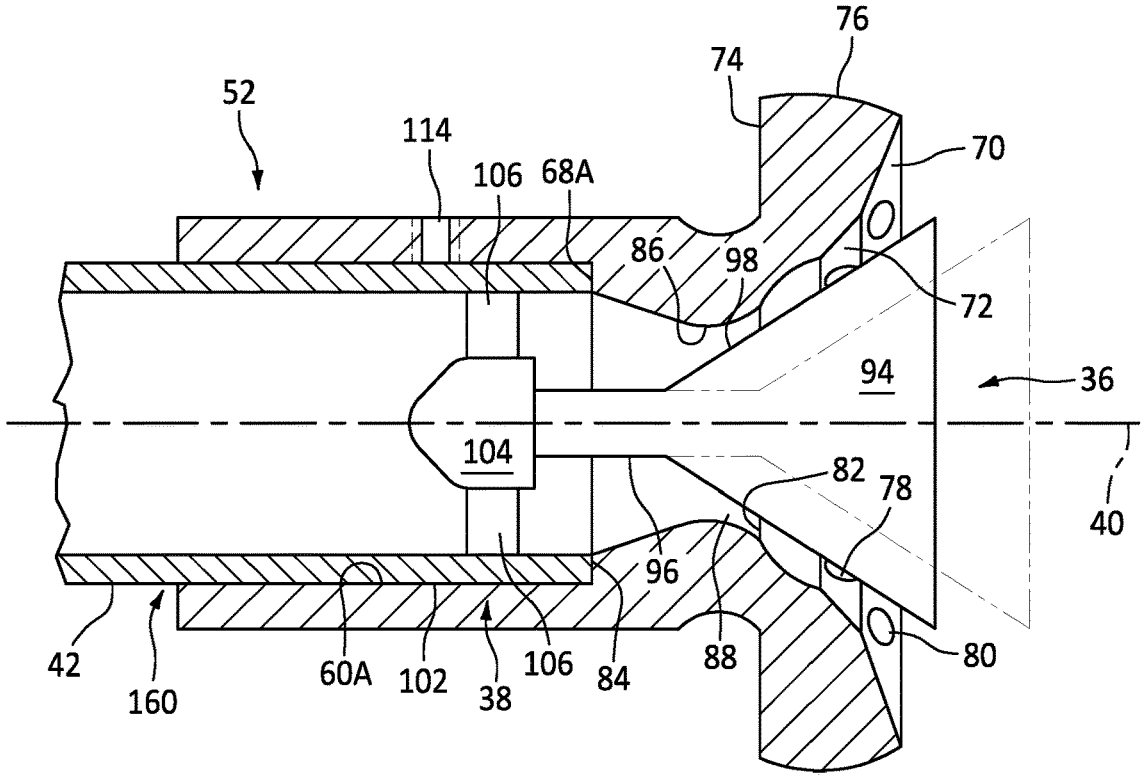
FIG. 8 is a diagrammatic planar sectioned view of a present disclosure fuel injector embodiment.

In the embodiment diagrammatically illustrated in FIG. 8, the swirler shaft 52 includes a single inner bore 160 defined by an inner radial surface 60A and a base surface 68A and the mounting stage 38 includes an extended annular flange 102 that extends outwardly from the swirler shaft 52 for connection with a fuel tube 42. In this embodiment, the distributor 36 may be attached to the central hub 104 but is not intended to be adjustably positioned relative to the central hub 104; i.e., the position of the distributor side wall surface 98 relative to the throat inner radial surface 86 is not intended to be selectively adjusted by changing the relative positions of the distributor 36 and the mounting stage central hub 104. In this embodiment, the position of the distributor side wall surface 98 relative to the throat inner radial surface 86 may be selectively adjusted by changing the axial position of the extended annular flange 102 relative to the swirler shaft 52. For example, the extended annular flange 102 may be in threaded engagement with the swirler inner bore 160 and the position may be adjusted by screwing the mounting stage 38 into the swirler inner bore 160 more or less. Alternatively, the annular flange 102 may have a slide fit with the swirler inner bore 160 and when the distributor 36 is in the desired position, a locking mechanism 114 (e.g., a set screw) can be used to secure the mounting stage 38/distributor 36 to prevent movement.

Figure 9:
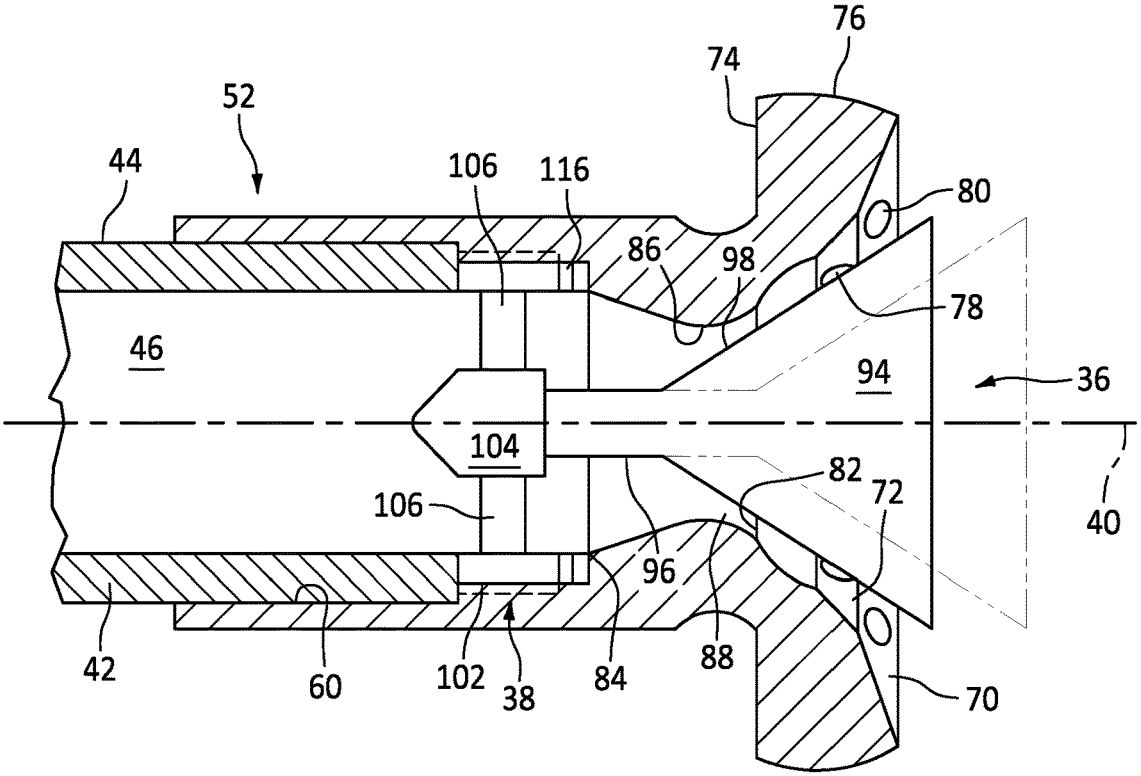
FIG. 9 is a diagrammatic planar sectioned view of a present disclosure fuel injector embodiment.
Figure 10:
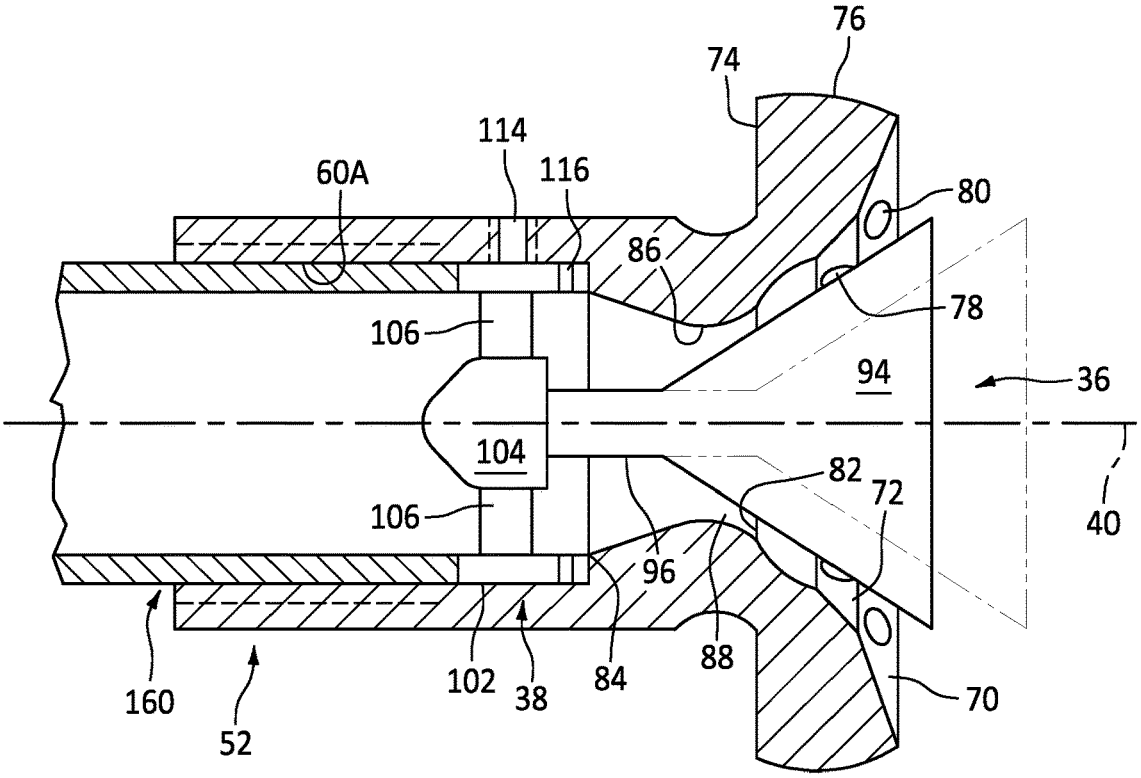
FIG. 10 is a diagrammatic planar sectioned view of a present disclosure fuel injector embodiment.

In the embodiment diagrammatically illustrated in FIG. 9, the mounting stage 38 and one or more shims 116 are disposed in the second inner bore 64 of the swirler shaft 52. The mounting stage 38 is secured within the second inner bore 64 in a manner described above (e.g., by threaded engagement and/or by a locking mechanism such as a set screw, or the like). The fuel tube 42 (or a coupler in communication with the fuel tube 42) extends into the first inner bore 60 of the swirler shaft 52 and is coupled with the swirler 34. In this embodiment, the distributor 36 may be attached to the central hub 104 but is not intended to be adjustably positioned relative to the central hub 104; i.e., the position of the distributor side wall surface 98 relative to the throat inner radial surface 86 is not selectively adjusted by changing the relative positions of the distributor 36 and the mounting stage central hub 104. In this embodiment, the position of the distributor side wall surface 98 relative to the throat inner radial surface 86 may be selectively adjusted by adding or removing shims 116 disposed in the second inner bore 64 of the swirler shaft 52. The shims 116 may be held within the second inner bore 64 of the swirler shaft 52 by the mounting stage 38, and the mounting stage 38 may be engaged with the swirler 34 by threaded engagement with the swirler second inner bore 64 or by a locking mechanism (e.g., a set screw), or both to prevent movement. The embodiment diagrammatically shown in FIG. 10 includes a fuel injector 32 embodiment similar to that shown in FIG. 8 with shims 116 for selective adjustment. In FIG. 10, the mounting stage 38 and shims 116 may be slidably received within the inner bore 160 and the fuel tube 42, or coupling, or other member may be threadedly engaged with the inner bore 160 to capture the mounting stage 38 and shims 116 within the inner bore.

During operation of the present disclosure fuel injector 32, fuel (gaseous or liquid) is passed through the fuel injector 32 and expelled into the combustor 26 for combustion. The fuel passes through the throat section 56 between the throat inner radial surface 86 and the distributor side wall surface 98. Subsequently, the fuel flow mixes with air flow exiting the inner and outer radial apertures 78, 80. The orientation of the inner and outer radial apertures 78, 80 are chosen to provide a desirable flow distribution of the fuel and air mixture for combustion. The ability of the adjust the flow area between the throat inner radial surface 86 and the distributor side wall surface 98 facilitates producing uniform fuel/air mixture distributions for all of the fuel injectors 32 in the combustor 26.

As detailed herein, for a variety of reasons (e.g., part durability, control emissions, ignition and flame stability, and to provide uniformity amongst a plurality of fuel injectors 32 in a combustor 26) it is desirable to be able to selectively adjust the flow area through/calibrate a fuel injector 32. The ability to selectively adjust the flow area through/calibrate a fuel injector 32 also provides a desirable means to address manufacturing tolerances rather than manufacturing to exceedingly tight tolerances. Furthermore, in the event it is necessary to replace a fuel injector 32 in an existing engine, it may be desirable to adjust that replacement fuel injector 32 to match the existing fuel injectors to improve uniformity. The present disclosure fuel injector 32 makes this possible.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc. The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements. It is further noted that various method or process steps for embodiments of the present disclosure are described herein. The description may present method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

The invention claimed is:

1. A fuel injector for a gas turbine engine combustor, the fuel injector having an axial centerline, comprising:

a swirler having a shaft, a collar, a throat section, a first axial end, and a second axial end, wherein the shaft extends from the first axial end to the collar and includes an inner bore extending through the shaft, and the throat section includes an inner radial surface that defines a central passage that extends between the inner bore of the shaft and the collar, and the collar includes a plurality of apertures extending therethrough disposed radially outside of the central passage, wherein said apertures are located downstream of the throat section;

a mounting stage disposed in the inner bore, the mounting stage having an annular flange, a central hub, and at least one strut extending radially between the annular flange and the central hub; and a distributor having a stem attached to a head, the stem having a distal end opposite the head portion engaged with the central hub, wherein the head portion has an end surface and a side surface that extends between the end surface and the stem, and wherein the head has a diameter that decreases in a direction from the end surface to the stem;

wherein the distributor is selectively positionable relative to the throat section.

2. The fuel injector of claim 1, wherein the inner radial surface is separated from the side surface by a separation distance;

wherein the distributor is selectively positionable relative to the throat section in a first position having a first separation distance and in a second position having a second separation distance, and the second separation distance is greater than the first separation distance.

3. The fuel injector of claim 2, wherein the distributor head is conical-shaped and at least a portion of the side surface extends along a straight line.

4. The fuel injector of claim 2, wherein the distributor stem is threadedly engaged with the mounting stage central hub.

5. The fuel injector of claim 4, wherein the central hub includes a threaded aperture configured for threaded engagement with the distributor stem; and wherein in the first position, the distal end of the distributor stem is disposed a first engagement distance within the threaded aperture and in the second position the distal end of the distributor stem is disposed a second engagement distance within the threaded aperture, and the first engagement distance is greater than the second engagement distance.

6. The fuel injector of claim 5, wherein the mounting stage includes a stem locking mechanism configured to lock the distributor stem relative to the central hub.

7. The fuel injector of claim 6, wherein the stem locking mechanism includes a set screw.

8. The fuel injector of claim 5, wherein the at least one strut of the mounting stage is a plurality of vanes, each vane extending radially between the annular flange and the central hub.

9. The fuel injector of claim 1, wherein the inner bore includes a first inner bore disposed at a first inner bore diameter and a second inner bore disposed at a second inner bore diameter, wherein the second inner bore diameter is less than the first inner bore diameter;

wherein the mounting stage is disposed within the second inner bore and the first inner bore is configured to receive a fuel tube.

10. The fuel injector of claim 1, wherein the mounting stage is threadedly engaged with the inner bore.

11. The fuel injector of claim 10, further comprising at least one shim disposed axially between a base surface of the inner bore and the annular flange of the mounting stage.

12. The fuel injector of claim 10, wherein the inner bore includes a first inner bore disposed at a first inner bore diameter and a second inner bore disposed at a second inner bore diameter, wherein the second inner bore diameter is less than the first inner bore diameter;

wherein the mounting stage is threadedly engaged with the second inner bore; and wherein the fuel injector further comprises at least one shim disposed axially between a base surface of the second inner bore and the annular flange of the mounting stage.

13. The fuel injector of claim 1, wherein the mounting stage is received within the inner bore by a slide fit and a member threadedly engaged with the inner bore captures the mounting stage within the inner bore.

14. The fuel injector of claim 13, further comprising at least one shim disposed axially between a base surface of the inner bore and the annular flange of the mounting stage.

15. The fuel injector of claim 14, further comprising a mounting stage locking mechanism configured to lock the mounting stage relative to the swirler.

16. The fuel injector of claim 1, wherein the central passage has a first diameter at a first axial position between the inner bore of the shaft and the collar and a second diameter at a second axial position between the inner bore of the shaft and the collar, wherein the first axial position and the second axial position are axially spaced apart from one another, and the second diameter is less than the first diameter.

17. The fuel injector of claim 16, wherein the central passage converges in a direction from the first axial position to the second axial position and the second axial position is disposed closer to the collar than the first axial position.

18. The fuel injector of claim 1, wherein the fuel injector is configured for use with a gaseous fuel.

19. A method of calibrating a gas turbine engine combustor having a plurality of fuel injectors, the method comprising:

providing a plurality of fuel injectors that includes at least one adjustable fuel injector, the adjustable fuel injector including:

a swirler having a shaft, a collar, a throat section, a first axial end, and a second axial end, wherein the shaft extends from the first axial end to the collar and includes an inner bore extending through the shaft, and the throat section includes an inner radial surface that defines a central passage that extends between the inner bore of the shaft and the collar, and the collar includes a plurality of apertures extending therethrough disposed radially outside of the central passage, wherein said apertures are located downstream of the throat section;

a mounting stage disposed in the inner bore, the mounting stage having an annular flange, a central hub, and at least one strut extending radially between the annular flange and the central hub; and a distributor having a stem attached to a head, the stem having a distal end opposite the head portion engaged with the central hub, wherein the head portion has an end surface and a side surface that extends between the end surface and the stem, and wherein the head has a diameter that decreases in a direction from the end surface to the stem;

wherein the distributor is selectively positionable relative to the throat section;

adjusting the at least one adjustable fuel injector (AFI) by positioning the distributor relative to the throat section of the adjustable fuel injector to produce an AFI fuel flow distribution that substantially matches a fuel flow distribution of each of the other of the fuel injectors of the plurality of fuel injectors.

20. The method of claim 19, wherein the plurality of fuel injectors are configured for use with a gaseous fuel.

* * * * *